US006244013B1

(12) United States Patent
Lee

(10) Patent No.: US 6,244,013 B1
(45) Date of Patent: Jun. 12, 2001

(54) COMBINATION GRILLE FOR WINDOW

(76) Inventor: Ming-Kun Lee, 2/F., No. 13, Hsing-Nan St. Nan-Kang Dist., Taipei City (TW)

( * ) Notice: Subject to any disclaimer, the term of this patent is extended or adjusted under 35 U.S.C. 154(b) by 0 days.

(21) Appl. No.: 09/412,429

(22) Filed: Oct. 5, 1999

(51) Int. Cl.[7] ..... E04C 2/42

(52) U.S. Cl. ..... 52/667; 52/664; 52/660; 49/50

(58) Field of Search ..... 52/664, 656.8, 52/106, 667, 287.1, 288.1, 507; 49/50

(56) References Cited

U.S. PATENT DOCUMENTS 5,406,762 * 4/1995 Buard ..... 52/287.1
6,085,481 * 7/2000 Lee ..... 52/656.8

* cited by examiner

*Primary Examiner*—Carl D. Friedman
*Assistant Examiner*—Pat J. Chavez

(74) *Attorney, Agent, or Firm*—Rosenberg, Klein & Lee

(57) ABSTRACT

A combination grille for window, which includes four hollow side frame bars arranged at four sides, and crossed hollow transverse frame bars and hollow longitudinal frame bars arranged within the side frame bars, and a plurality of sliding cover plates respectively covered on the side frame bars and the transverse frame bars, wherein the side frame bars and the transverse frame bars each have a longitudinal opening at one side, two sliding grooves longitudinally extended along two opposite sides of the longitudinal opening; the side frame bars each have a longitudinal series of coupling holes at one side adjacent to the respective longitudinal opening; the transverse frame bars each have a plurality of longitudinally spaced transverse through holes across the respective longitudinal opening for the passing of the longitudinal frame bars; the sliding cover plates are respectively covered on the longitudinal opening at each of the transverse frame bars and the side frame bars, each having two coupling flanges longitudinally disposed at two opposite lateral sides and respectively inserted into the sliding grooves at each of the side frame bars and the transverse frame bars.

6 Claims, 4 Drawing Sheets

COMBINATION GRILLE FOR WINDOW

BACKGROUND OF THE INVENTION

The Present invention relates to a combination grille, and more particularly to a combination grille that can easily and quickly set up without the use of a tool.

Various grilles for window have been disclosed, and appeared on the market. Similar designs are shown in U.S. Pat. No. 5,813,187 and U.S. Ser. No. 09/165,497. These two designs are also invented by the present inventor, and can be conveniently set up without the use of a tool. However, these two designs still have minor drawbacks. The main drawback of these two designs is the complicated procedure of processing through holes or plugholes on the component parts, resulting in a high cost.

SUMMARY OF THE INVENTION

It is one object of the present invention to provide a combination grille, which can easily quickly be set up without the use of a tool. It is another object of the present invention to provide a combination grille, which is inexpensive to manufacture. According to one embodiment of the present invention, the combination grille for window comprises four hollow side frame bars arranged at four sides, and crossed hollow transverse frame bars and hollow longitudinal frame bars arranged within the side frame bars, and a plurality of sliding cover plates respectively covered on the side frame bars and the transverse frame bars, wherein the side frame bars and the transverse frame bars each comprise a longitudinal opening at one side, two sliding grooves longitudinally extended along two opposite sides of the longitudinal opening; the side frame bars each have a longitudinal series of coupling holes at one side adjacent to the respective longitudinal opening; the transverse frame bars each have a plurality of longitudinally spaced transverse through holes across the respective longitudinal opening for the passing of the longitudinal frame bars; the sliding cover plates are respectively covered on the longitudinal opening at each of the transverse frame bars and the side frame bars, each having two coupling flanges longitudinally disposed at two opposite lateral sides and respectively inserted into the sliding grooves at each of the side frame bars and the transverse frame bars. Because the side frame bars and the transverse frame bars are respectively shaped like a channel bar, it is easy to process through holes at the frame bars.

DETAILED DESCRIPTION OF THE PREFERRED EMBODIMENT

Figure 1:
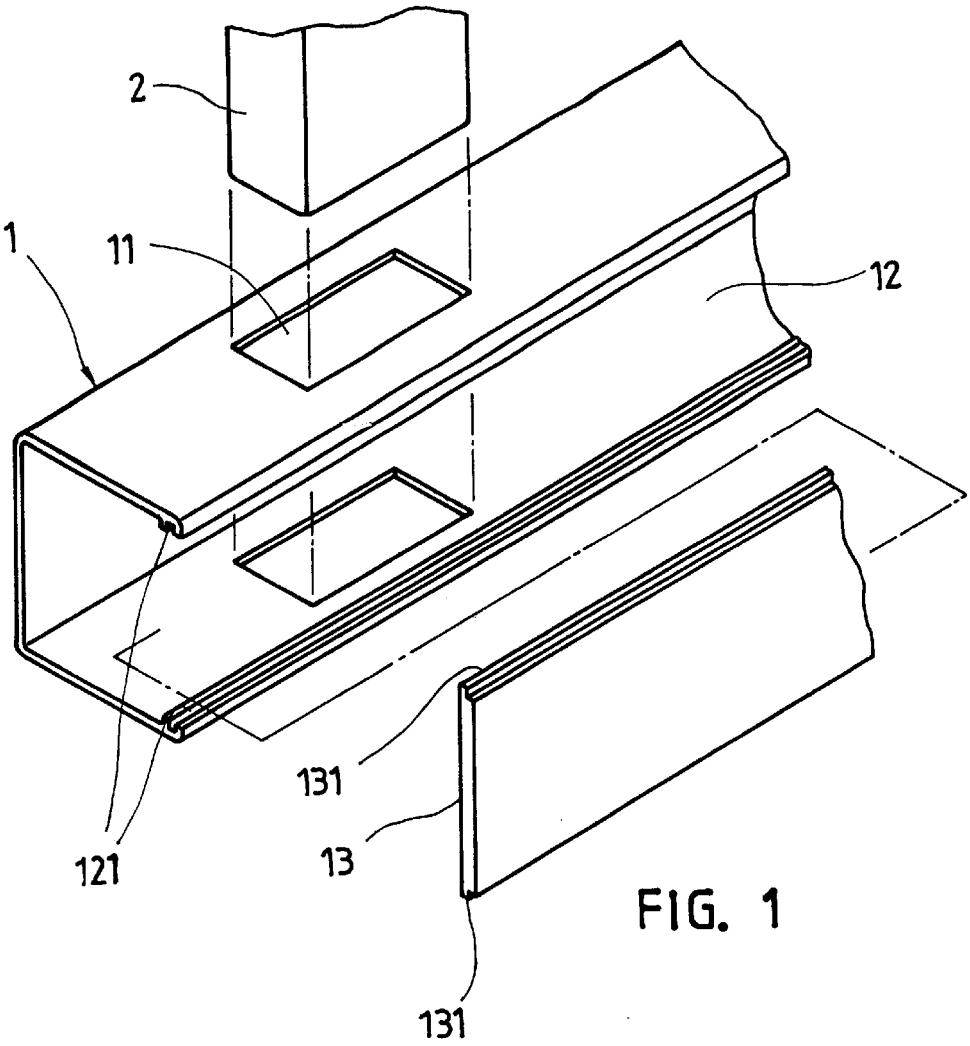
FIG. 1 is an exploded view of a part of a combination grille according to a first embodiment of the present invention.
Figure 2:
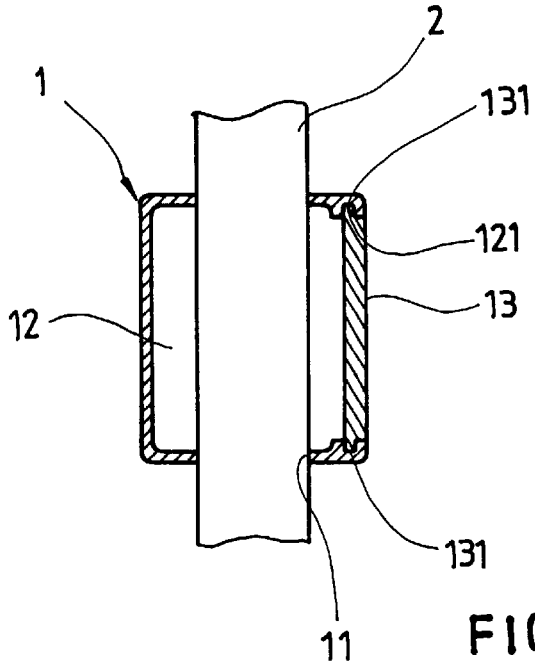
FIG. 2 is a sectional view of a part of the first embodiment of the present invention, showing one longitudinal frame tube and one transverse frame tube connected together.
Figure 3:
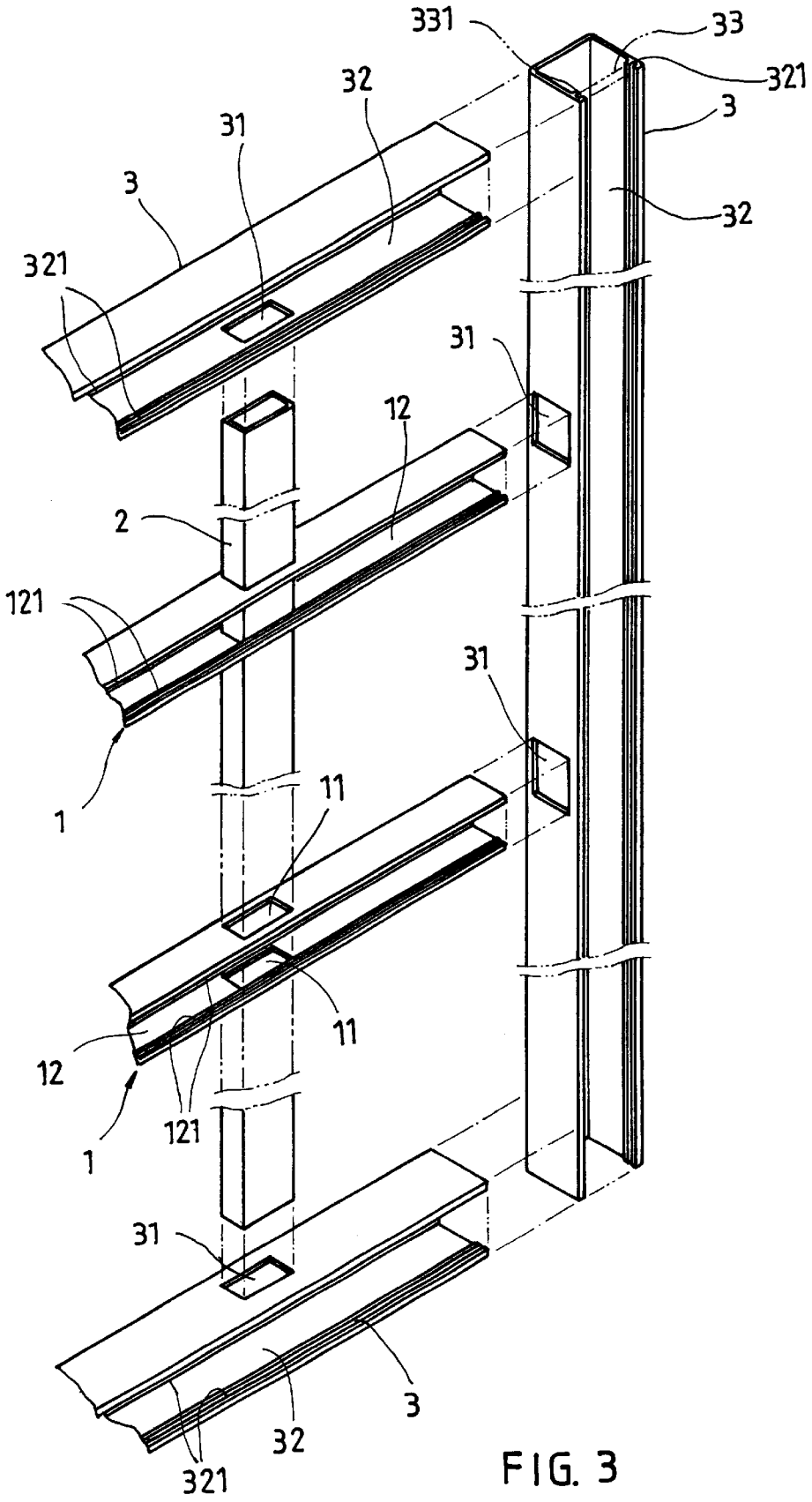
FIG. 3 is another exploded view of the first embodiment of the present invention.
Figure 4:
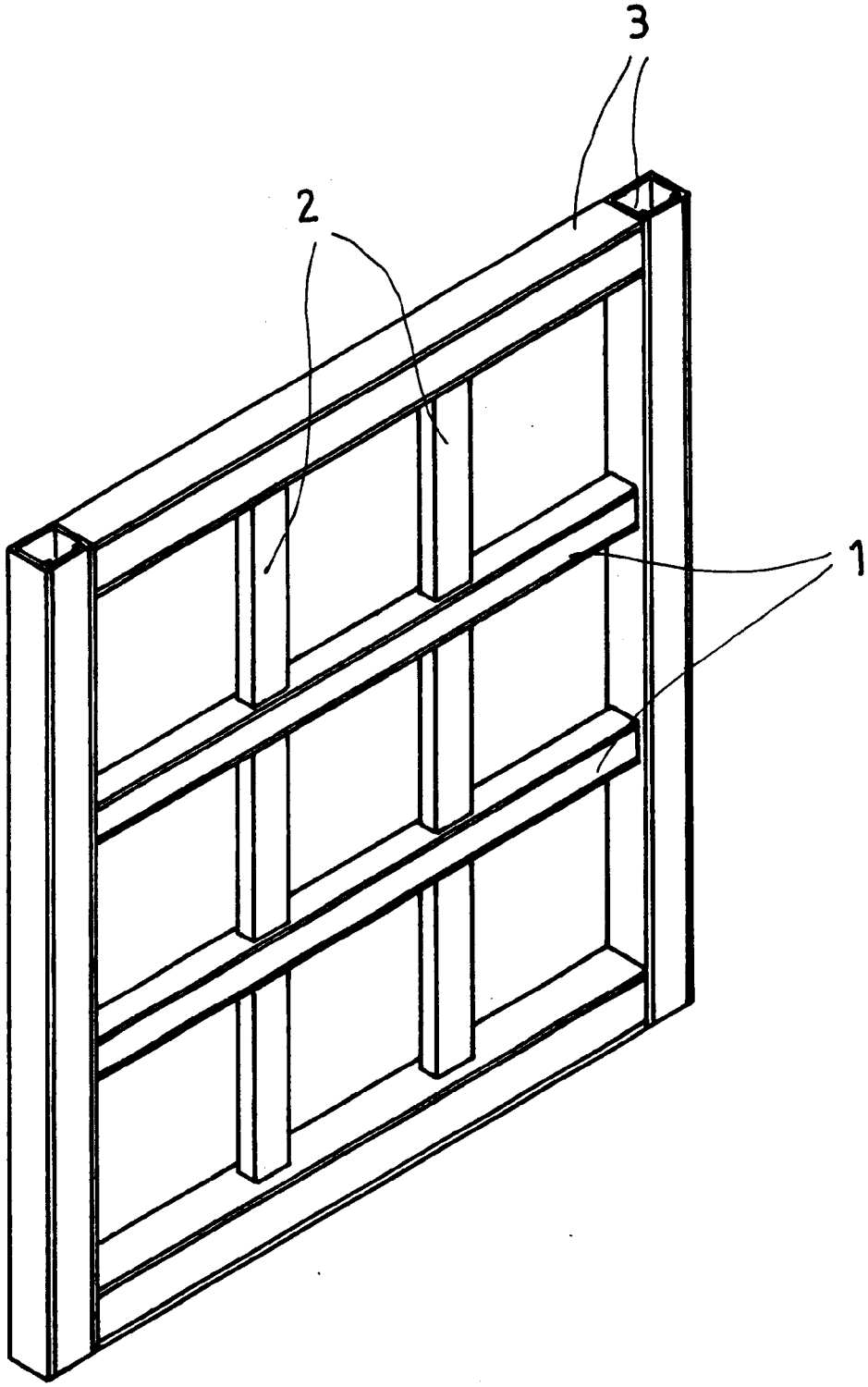
FIG. 4 is a perspective view of a combination grille according to the present invention.

Referring to FIGS. from 1 through 4, a combination grille in accordance with the first embodiment of the present invention is shown comprised of a plurality of hollow side frame bar 3 arranged at four sides, a plurality of hollow transverse frame bars 1 arranged in parallel and connected between two of the side frame bars 3, and a plurality of hollow longitudinal frame bars 2 respectively connected between the other two side frame bars 3 across the transverse side frame bars 1. The hollow side frame bars 3 each comprise a longitudinal opening 32 at one side, two sliding grooves 321 longitudinally extended along two opposite sides of the longitudinal opening 32, and a longitudinal series of coupling holes 31 at one side adjacent to the longitudinal opening 32. A sliding cover plate 33 is respectively covered on the longitudinal opening 32 at each of the side frame tubes 3. The sliding cover plate 33 comprises two coupling flanges 331 longitudinally disposed at two opposite lateral sides thereof, and respectively inserted into the sliding grooves 321 at one side frame tube 3. The hollow transverse frame bars 1 each comprise a longitudinal opening 12 at one side, two sliding grooves 121 longitudinally extended along two opposite sides of the longitudinal opening 12, and a plurality of longitudinally spaced transverse through holes 11 across the longitudinal opening 12 for the passing of the longitudinal frame bars 2. A sliding cover plate 13 is respectively covered on the longitudinal opening 12 at each of the transverse frame bars 1. The sliding cover plate 13 comprises two coupling flanges 131 longitudinally disposed at two opposite lateral sides thereof, and respectively inserted into the sliding grooves 121 at one transverse frame bar 1.

Figure 5:
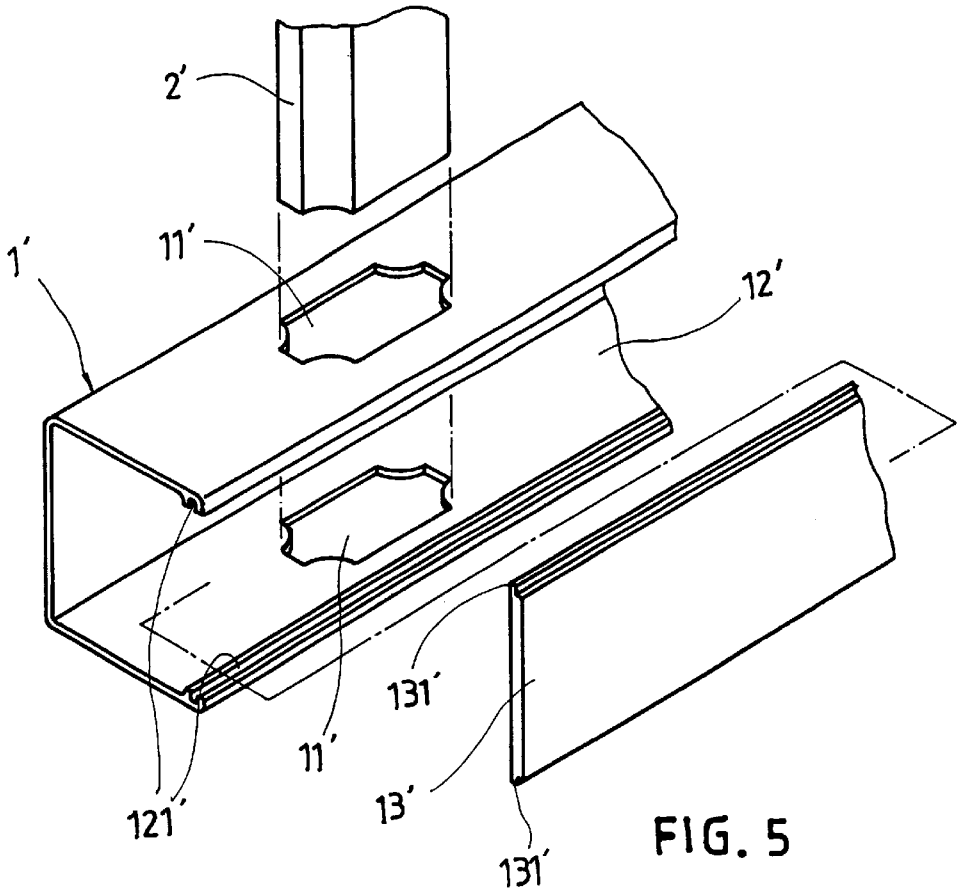
FIG. 5 is an exploded view of a part of a combination grille according to a second embodiment of the present invention.

FIG. 5 shows an alternate form of the present invention. According to this alternate form, each hollow transverse frame bar 1' has a longitudinal opening 12' at one side, two sliding grooves 121' longitudinally extended along two opposite sides of the longitudinal opening 12', and a plurality of longitudinally spaced transverse through holes 11' across the longitudinal opening 12' for the passing of the longitudinal frame bars 2'. The matched sliding cover plate 13' comprises two coupling flanges 131' longitudinally disposed at two opposite lateral sides thereof, and respectively inserted into the sliding grooves 121' at one transverse frame bar 1'. According to this alternate form, the through holes 11' at the hollow transverse frame bar 1' are polygonal through holes, and the longitudinal frame bar 2' has a polygonal cross section fitting the polygonal through holes 11'.

Figure 6:
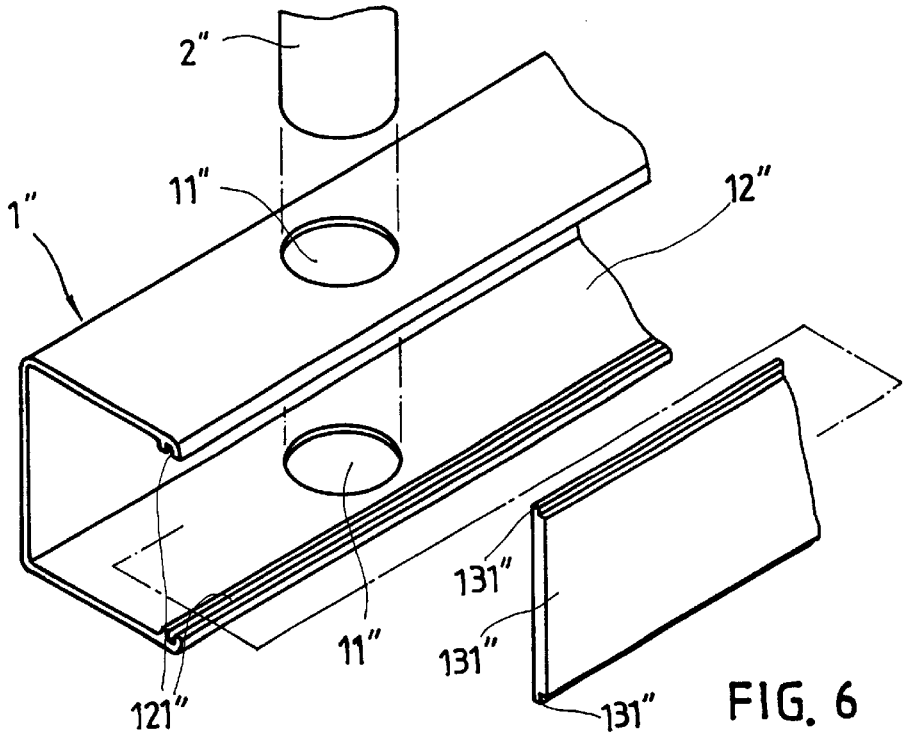
FIG. 6 is an exploded view of a part of a combination grille according to a third embodiment of the present invention.

FIG. 6 shows another alternate form of the present invention. According to this alternate form, the through holes 11" at the hollow transverse frame bar 1' are circular through holes, and the longitudinal frame bar 2' has a circular cross section fitting the circular through holes 11'.

It is to be understood that the drawings are designed for purposes of illustration only, and are not intended as a definition of the limits and scope of the invention disclosed.

What the invention claimed is:

1. A grille assembly comprising:

(a) a frame formed by a plurality of elongate side frame bar members defining at least four sides, each of said side frame bar members having a pair of opposed first and second wall portions defining a longitudinal opening therebetween, each said first and second wall portion having formed therein a longitudinally extended sliding groove, at least one of said first and second wall portions having formed therein a plurality of longitudinally spaced coupling holes;

(b) a plurality of spaced first bar members extending between a first pair of said side frame bar members, each said first bar member having a pair of opposed first and second surface portions defining a longitudinal opening therebetween, each said first and second surface portion having formed therein a longitudinally extended sliding groove, each of said first and second surface portions having formed therein a plurality of longitudinally spaced transverse through holes;

(c) a plurality of spaced second bar members extending between a second pair of said frame bar members, each said second bar member extending transversely through a pair of said transverse through holes of each said first bar member; and, (d) a plurality of elongate first and second cover plate members coupled respectively to said first bar members and said side frame bar members, said first and second cover plate members each having formed thereon a pair of coupling flanges extending from opposing elongate sides thereof, said coupling flanges of each said first cover plate member slidably engaging said sliding grooves of one said first bar member, said coupling flanges of each said second cover plate member slidably engaging said sliding grooves of one said side frame bar member.

2. The grille assembly as recited in claim 1 wherein opposing ends of each said first bar member respectively engage opposed ones of said coupling holes of said first side frame bar member pair.

3. The grille assembly as recited in claim 2 wherein opposing ends of each said second bar member respectively engage opposed ones of said coupling holes of said second side frame bar member pair.

4. The grille assembly as recited in claim 1 wherein said first bar members extend horizontally one parallel to the others.

5. The grille assembly as recited in claim 1 wherein said transverse through holes of said first bar member each describe a predetermined polygonal shape, said second bar members each having a sectional contour conforming substantially thereto.

6. The grille assembly as recited in claim 1 wherein said transverse through holes of said first bar member each describe a circular shape, said second bar members each having a sectional contour conforming substantially thereto.

* * * * *